US006416249B1

(12) United States Patent
Crupi

(10) Patent No.: US 6,416,249 B1
(45) Date of Patent: Jul. 9, 2002

(54) MIXING APPARATUS AND METHOD FOR BLENDING MILLED ASPHALT WITH REJUVENATING FLUID

(76) Inventor: Francesco A. Crupi, 2845 Seabreeze Dr. South, Gulfport, FL (US) 33707

( * ) Notice: Subject to any disclaimer, the term of this patent is extended or adjusted under 35 U.S.C. 154(b) by 0 days.

(21) Appl. No.: 09/592,398

(22) Filed: Jun. 13, 2000

(51) Int. Cl.[7] ..... E01C 23/12

(52) U.S. Cl. ..... 404/91; 404/92; 404/95; 404/77; 404/90; 404/75

(58) Field of Search ..... 404/75, 77, 79, 404/82, 90, 91, 92, 95

(56) References Cited

U.S. PATENT DOCUMENTS

| | | | | | |
|---|---|---|---|---|---|
| 3,843,274 | A | * | 10/1974 | Gutman et al. | 404/91 |
| 3,907,450 | A | * | 9/1975 | Cutler | 404/90 |
| 3,970,404 | A | * | 7/1976 | Benedetti | 404/77 |
| 3,989,401 | A | | 11/1976 | Moench | 404/95 |
| 4,011,023 | A | * | 3/1977 | Cutler | 404/91 |
| 4,124,325 | A | * | 11/1978 | Cutler | 404/75 |
| 4,226,552 | A | * | 10/1980 | Moench | 404/92 |
| 4,300,853 | A | | 11/1981 | Jones | 404/92 |
| 4,317,642 | A | * | 3/1982 | Wirtgen | 404/91 |
| 4,335,974 | A | | 6/1982 | Wirtgen | 404/92 |
| 4,347,016 | A | * | 8/1982 | Sindelar et al. | 404/95 |
| 4,545,700 | A | * | 10/1985 | Yates | 404/75 |
| 4,682,909 | A | * | 7/1987 | Mihara | 404/90 |
| 4,780,022 | A | | 10/1988 | Ohiba et al. | 404/90 |
| 4,784,518 | A | * | 11/1988 | Cutler | 404/79 |
| 4,793,730 | A | * | 12/1988 | Butch | 404/77 |
| 4,946,307 | A | * | 8/1990 | Jakob | 404/91 |
| 4,971,476 | A | * | 11/1990 | Guillon | 404/91 |
| 4,974,993 | A | * | 12/1990 | Crabbi | 404/79 |
| 5,000,615 | A | | 3/1991 | Murray | 404/75 |
| 5,002,426 | A | | 3/1991 | Brown et al. | 404/92 |
| 5,046,890 | A | | 9/1991 | Dickson | 404/90 |
| 5,080,524 | A | * | 1/1992 | Lee | 404/90 |
| 5,219,450 | A | | 6/1993 | Thurk | 404/91 |
| 5,472,292 | A | * | 12/1995 | Wiley | 404/79 |
| 5,741,085 | A | * | 4/1998 | Wirtgen | 404/75 |
| 5,791,814 | A | * | 8/1998 | Wiley | 404/91 |
| 5,967,695 | A | * | 10/1999 | Vural | 404/77 |
| 6,220,782 | B1 | * | 4/2001 | Yates | 404/75 |

OTHER PUBLICATIONS

Francesco A. Crupi, co–pending U.S. Patent application S/N 09/593,621 entitled "Method and Apparatus for Controlling the Mixing of Milled Asphalt Aggregate with Rejuvenating Fluid," filed Jun. 13, 2000, in its entirety.

Francesco A. Crupi, co–pending U.S. Patent application S/N 09/592,773 entitled "Asphalt Rake with Ride Up Capability," filed Jun. 13, 2000, in its entirety.

* cited by examiner

*Primary Examiner*—Robert E. Pezzuto
*Assistant Examiner*—Alexandra K Pechhold
(74) *Attorney, Agent, or Firm*—Butler, Snow O'Mara, Stevens & Cannada, PLLC

(57) ABSTRACT

A blending apparatus which forms part of an asphalt pavement resurfacing machine has first and second stages. The first stage receives milled material through an inlet and blends the milled material with a rejuvenating fluid. The first stage has a transversely extending shaft from which paddles extend radially to blend the milled material with the rejuvenating fluid and direct it toward a first stage outlet. The second stage receives the blended material from the first stage outlet. The second stage has a respective shaft with mixing paddles extending radially therefrom to further blend the material and direct it toward a second stage outlet.

12 Claims, 3 Drawing Sheets

MIXING APPARATUS AND METHOD FOR BLENDING MILLED ASPHALT WITH REJUVENATING FLUID

FIELD OF THE INVENTION

This invention relates to apparatus for in situ rejuvenation of asphalt pavement. More particularly this invention relates to a method and apparatus for mixing milled asphalt and rejuvenating fluid in such rejuvenation.

BACKGROUND OF THE INVENTION

Asphalt pavement consists essentially of an aggregate and sand mixture held together with a petroleum based binder, such as tar. With continued exposure to sun, moisture, traffic, freezing and thawing, asphalt pavement degrades. The degradation is principally in the binder, rather than the aggregate and sand mixture which makes up the bulk of the asphalt pavement. Also, much of the degradation occurs within the top two or three inches of the surface.

Traditionally, worn asphalt pavement was not restored but instead was torn up and replaced with new asphalt pavement. This is a costly approach and creates a problem as to what to do with the torn up pavement. Accordingly, techniques and apparatus have been developed for restoring or rejuvenating the top few inches of an asphalt pavement surface.

A typical road resurfacing machine has a heater for heating and softening the asphalt pavement surface as it passes along the surface. Following the heater is a "rake" or "scarifier" which breaks up or "scarifies" the softened pavement. The scarified pavement is generally crushed or "milled", blended with rejuvenating fluid and optionally additional sand or aggregate and redeposited. The redeposited material is spread out and rolled to create a rejuvenated surface comparable in quality to the original surface before degradation.

In order to produce a rejuvenated surface of high quality, it is important to ensure that an appropriate amount of rejuvenating fluid is added. Generally, a core sample or several core samples are initially taken of the surface to be rejuvenated and a desired ratio of rejuvenating material to milled material is analytically determined.

It is also important to thoroughly intermingle the milled material with the rejuvenating material, which will at least include a fluid but may also include additional sand and/or aggregate.

It is an object of the present invention to provide a method and apparatus for thoroughly blending the milled material with at least the rejuvenating fluid and with any other rejuvenating materials.

SUMMARY OF THE INVENTION

A mixer for an asphalt resurfacing machine which has a transport structure to which is mounted a heater for heating an underlying surface, a scarifier following the heater to break up the heated surface, a mill following the scarifier for grinding the scarified surface to form a milled material and prepare the underlying surface to a pre-set depth and a rejuvenating fluid sprayer for introducing a rejuvenating fluid to the milled material. The mixer has a first stage, including a shell which is substantially enclosed but for a downwardly facing bottom opening. An inlet opening extends through a forward face of the shell and faces in a travel direction of the transport structure. The inlet opening receives milled material from the mill. A first stage shaft extends transversely relative to the travel direction and is mounted to the first stage shell for rotation about a first stage shaft axis. A plurality of paddles extend radially from the first stage shaft for blending the rejuvenating fluid with the milled material and to direct the blended material thus formed toward a first stage discharge outlet facing rearwardly relative to the travel direction. The first stage shell is placeable in close proximity to the underlying surface to use the underlying surface as a bottom part thereof. A rotator is provided for rotating the shaft along with the paddles.

The mixer may include a second stage mounted to follow the first stage and receive blended material from the discharge outlet of the first stage. The second stage has a downwardly opening second stage shell extending from the rear of the first stage shell. A second stage shaft is mounted in the second stage shell for rotation about a second stage shaft axis generally parallel to the first stage shaft axis. A plurality of paddles extend substantially radially from the second stage shaft. The paddles are rotatable with the second stage shaft for further blending of the blended material and for directing the blended material toward a second stage discharge opening through the second stage shell which faces rearwardly relative to the travel direction. The second stage also has a rotator for rotating the second stage shaft about the second stage shaft axis.

The rotator may be a motor having a sprocket and chain arrangement linking the motor to the first and second stage shafts.

A method is provided for blending milled material with rejuvenating fluid in an asphalt resurfacing machine having a first pug mill attached to a transport structure associated with the asphalt resurfacing machine in an inverted arrangement in which an open face of the first pug mill is adjacent an underlying surface for the underlying surface to act as a bottom of the pug mill, the first pug mill having a first paddle shaft extending generally transversely relative to a travel direction of the transport structure, the method comprises the steps of:

(i) moving the transport structure along the underlying surface to move the first pug mill in the travel direction;

(ii) receiving the milled material and rejuvenating fluid into the first pug mill through a forwardly facing first inlet;

(iii) blending the milled material with the rejuvenating fluid by rotating the first paddle shaft to cause paddles extending radially therefrom to co-mingle the milled material with the rejuvenating fluid, the paddles being aligned to direct a blended material thus formed toward a rearwardly facing first discharge opening; and, (iv) allowing the blended material to be discharged through the first discharge opening as the first pug mill moves in the travel direction.

A second pug mill may be attached to the transport structure to follow the first pug mill, the second pug mill being mounted in an inverted arrangement in which an open face thereof is adjacent the underlying surface to utilize the underlying surface as a bottom thereto, the second pug mill having a second inlet- for receiving the blended material discharged from the first discharge opening, the second pug mill having a second paddle shaft generally parallel to the first paddle shaft and having a plurality of paddles extending substantially radially therefrom and the method may include the further steps of:

(v) receiving the blended material into the second pug mill through the second inlet;

(vi) rotating the second paddle shaft to further blend the blended material received from the first pug mill, the paddles being aligned to direct further blended material thus formed toward a rearwardly facing second discharge opening; and, (vii) discharging the further blended material in a windrow from the second discharge opening.

DESCRIPTION OF THE DRAWINGS

Preferred embodiments of the present invention are described below with reference to the accompanying drawings in which.

DESCRIPTION OF PREFERRED EMBODIMENTS

Figure 1:
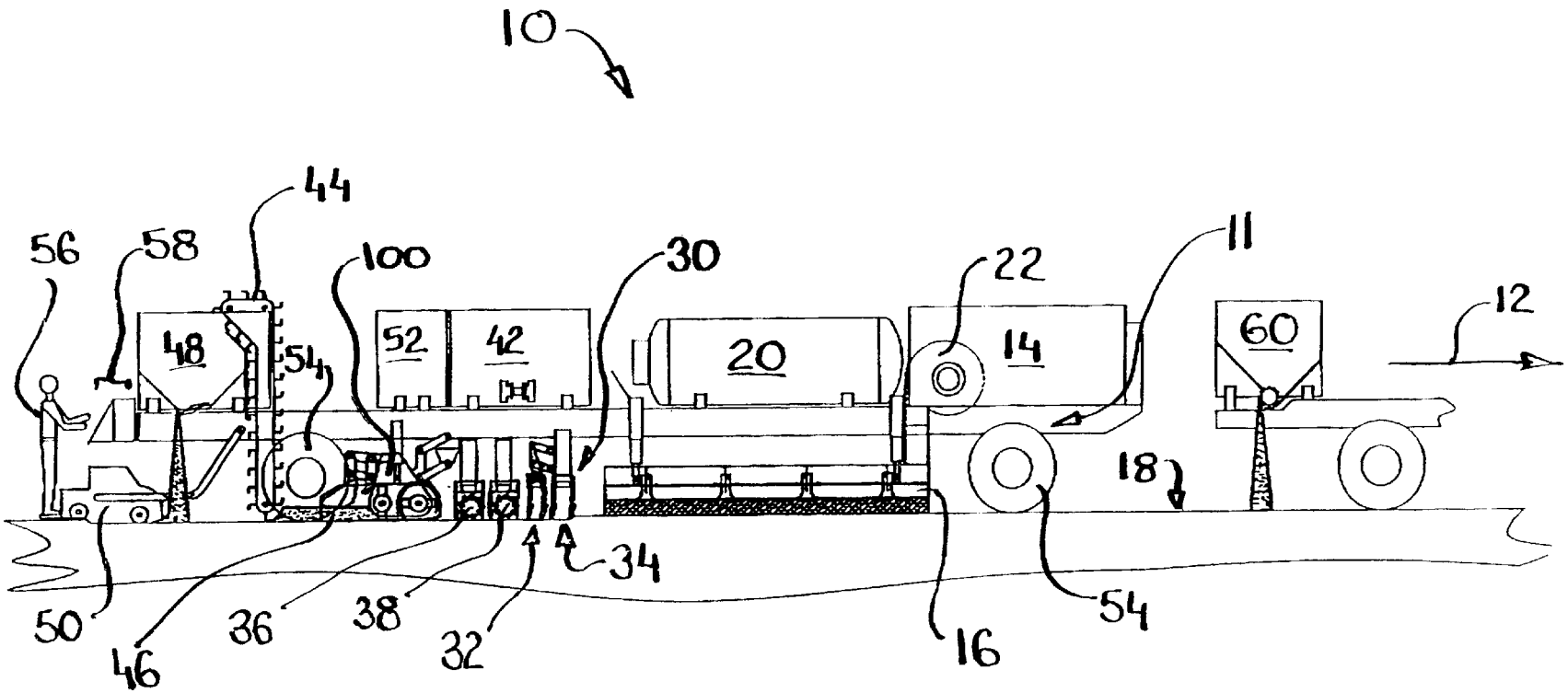
FIG. 1 is a schematic representation of an asphalt resurfacing machine according to the present invention.

An asphalt resurfacing machine is generally indicated by reference 10 in FIG. 1. The resurfacing machine 10 travels in a path of travel indicated by arrow 12. The resurfacing machine 10 has a transport structure 1 1 to which its various components are mounted. The transport structure 11 is basically a support frame having wheels or tracks 54. A power plant 14 at the front of the transport structure 11 is provided to drive the apparatus and typically includes an engine and a hydraulic system.

Behind the power plant 14 and also mounted on the transport structure 11 is a heater 16 which includes numerous burners and associated plumbing for heating an asphalt pavement surface 18 upon which the resurfacing machine 10 travels. A propane (or other combustible fuel) tank 20 and a combustion blower 22 serve the burners in the heater 16. The heater 16 directs heat at the asphalt pavement surface 18 to cause softening of an upper part of the asphalt pavement surface 18.

The softened asphalt pavement surface 18 is initially dislodged by a raking device, generally indicated by reference 30, mounted to the transport structure 11, and which follows the heater 16. The raking device 30 has rakes which dislodge the heated asphalt pavement surface 18. The raking device 30 may include main rakes 32 and extension rakes 34, the extension rakes 34 performing a similar function to the main rakes 32, but to the outside edges. The main rakes 32 break up material around manholes where a main mill 36 behind the raking device 30 cannot run.

The raking device 30 may include main rakes 32 and extension rakes 34, the extension rakes 34 performing a similar function to the main rakes 32, but to the outside edges. The main rakes 32 break up material around manholes where a main mill 36 behind the raking device 30 cannot run.

The main mill 36 which is mounted to the transport structure 11 behind the raking device 30 grinds up the material dislodged by the rakes, levels the underlying surface and prepares the surface to a preset depth. Extension mills 38 ahead of the main mill 36 perform a similar function, but process outer material typically from 10 to 15 feet to each side of the resurfacing machine 10 and move it to a central part of the resurfacing machine 10 where it is subsequently processed by the main mill 36.

A pug mill 100, also mounted to the transport structure 11, follows the main mill 36 and acts as a mixer for blending the processed material from the main mill 36 with rejuvenating fluid from a tank 42. The pug mill 100 is described in more detail below after the general overview of the asphalt resurfacing machine 10.

Blended material 46 from the pug mill 100 is picked up by a scalping conveyor 44 which deposits the blended material 46 in a heated holding hopper 48. The holding hopper 48 keeps the blended material 46 hot until it is needed. The holding hopper 48 may be filled through its top with material for start ups or if additional material is needed. The holding hopper 48 may also be dumped if required or at the end of a day's operation.

A screed 50 follows the asphalt rejuvenating apparatus 10 and may be a unit such as typically found on an asphalt paver. The screed 50 lays, spreads and slightly compacts the blended material 46 for final rolling.

A water system 52 may be provided to supply cooling water to the front and rear tires or tracks 54.

An operator 56 operates a control and processing station 58. From initial core samples the amount of rejuvenating fluid, sand and aggregate required to bring the asphalt surface 18 up to a suitable specification can be determined. The operator 56 can input and monitor the amounts of rejuvenating fluid, sand and aggregate being added.

A sand/aggregate bin 60 precedes the asphalt rejuvenating apparatus 10. The sand/aggregate bin 60 may be attached to the asphalt rejuvenating apparatus 10 or attached to a separate machine (not shown) running in front thereof. Sand/aggregate is metered at a specific rate which is a function of ground speed and specification requirements.

Figure 3:
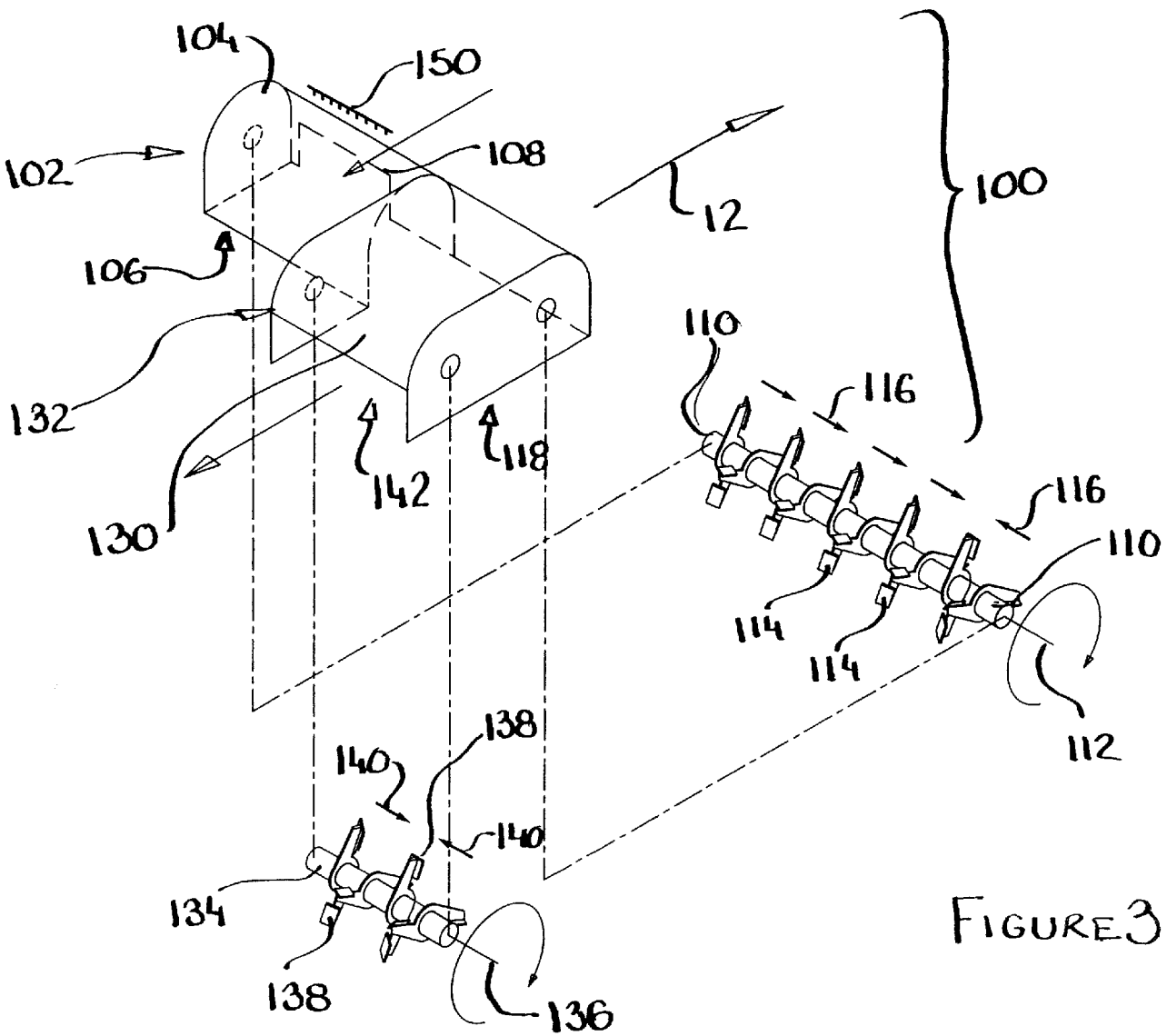

The mixer or "pug mill" 100 is shown in more detail in the exploded view of FIG. 3. The mixer 100 has a first stage 102 which includes a housing or "first stage shell" 104 which is substantially enclosed but for a downwardly facing bottom opening 106. The first stage shell 104 has an inlet opening 108 through a forward face thereof which faces in the travel direction 12 of the transport structure 11.

The first stage 102 in use is placed in close proximity to the underlying surface to form a substantially enclosed chamber with the underlying surface acting as a bottom part of the first stage 102. A hydraulic cylinder 120 and parallel bar linkage 122 in FIG. 2 mount the mixer 100 to the transport structure 11 and control the placement of the first stage 102.

A first stage shaft 110 is mounted to the first stage shell 104 for rotation about a first stage shaft axis 112 which extends transversely relative to the travel direction 12. A plurality of paddles 114 extend from the first stage shaft 110 in a direction generally radial relative to the first stage shaft axis 112. The paddles 114 are rotatable with the first stage shaft 110 within the enclosed chamber to blend the milled material with the rejuvenating fluid. The paddles 114 are aligned to direct the blended material (46 in FIGS. 1 and 2) generally in the direction of arrows 1 16 toward a discharge outlet 1 18. The discharge outlet 118 faces rearwardly relative to the travel direction 112 and the blended material 46 is discharged therefrom as the resurfacing machine 10 moves in the forward direction 12.

Figure 2:
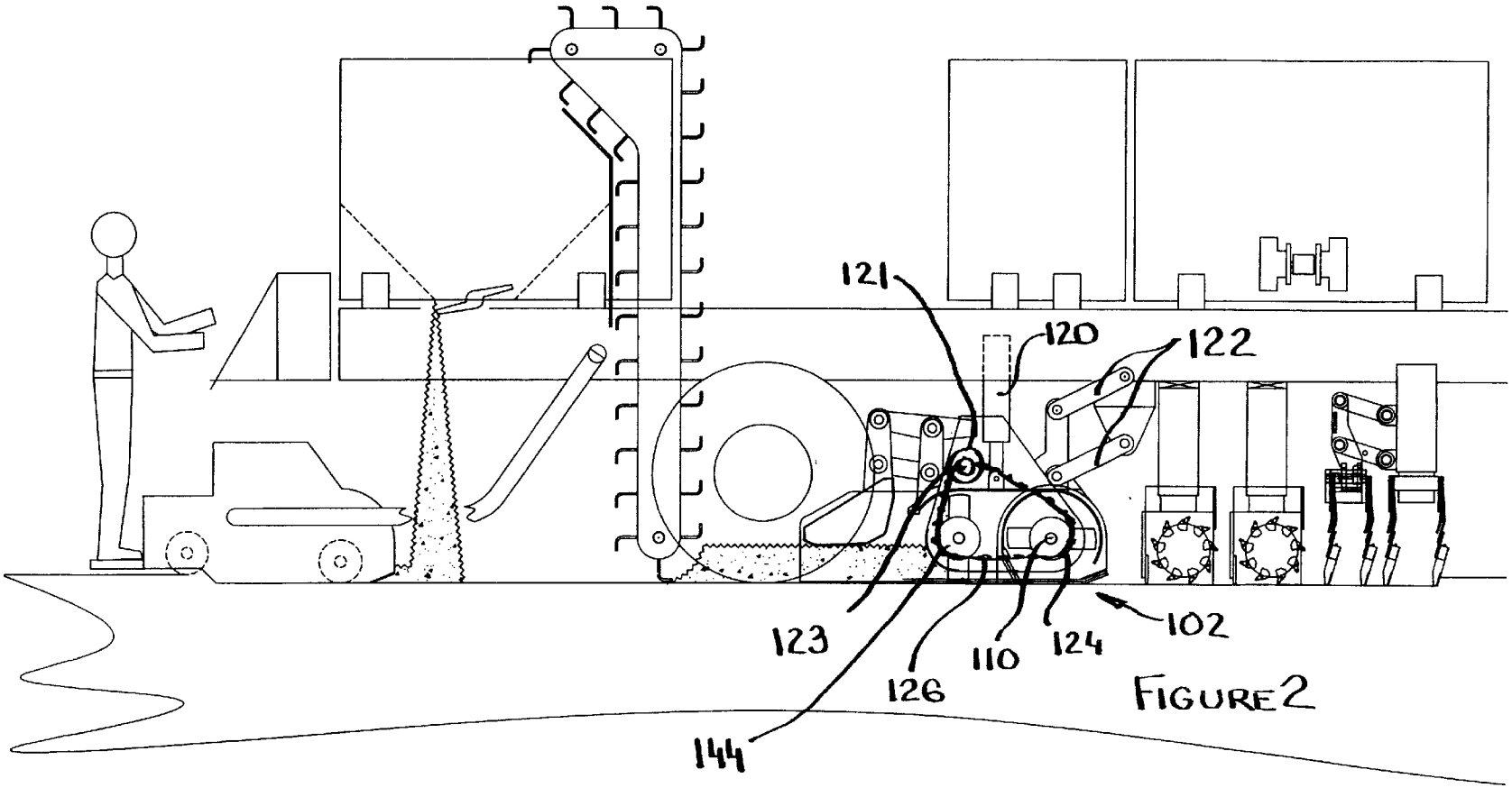
FIG. 2 is an enlarged view of the rearward portion of the asphalt resurfacing machine of FIG. 1; and, FIG. 3 is an exploded view of a mixer according to the present invention.

A rotator for rotating the first stage shaft 110 may take a variety of forms. For example, as illustrated in FIG. 2, a motor 121 may be mounted to the pug mill 102 and rotationally coupled to the first stage shaft 110 by a motor sprocket 123 mounted to the motor 121, a first stage shaft sprocket 124 mounted to the first stage shaft 110 and a roller chain 126 extending therebetween. It will be appreciated by those skilled in driver apparatus for such machinery that the rotator could take a variety of other forms. For example, a direct gear drive may be used instead of the sprocket and chain drive illustrated, or the motor 120 could be directly coupled to the first stage shaft 110.

Preferably, for better blending, the blended material will not be immediately discharged from the first stage discharge outlet 118, but rather will be further blended in a second stage 130 which follows the first stage 102. The second stage receives blended material from the first stage discharge outlet 118. The second stage 130 has a downwardly opening second stage shell 132, which may be integral with and extend from the first stage shell 104. A second stage shaft 134 is mounted in the second stage shell 132 for rotation about a second stage shaft axis 136.

A plurality of paddles 138 extend generally radially from the second stage shaft 134 and are rotatable therewith to further blend the blended material 46. The paddles 138 are oriented to direct the blended material 46 in the direction of arrows 140 toward the second stage discharge opening 142.

The second stage discharge opening 142 faces rearwardly relative to the travel direction 12. The blended material is preferably discharged from the second stage discharge opening 142 in a windrow of fixed breadth determined by the breadth of the second stage discharge opening 142.

A rotator for rotating the second stage shaft 134 may, as illustrated in FIG. 2, be a second stage shaft sprocket 144 mounted to the second stage shaft 110 and about which the roller chain 126 extends.

Rejuvenating fluid may be added at various points in the resurfacing process. Preferably rejuvenating fluid should be added to the milled material prior to its entering the pug mill 100. This may be accomplished by adding rejuvenating fluid at or before the main mill 36 or ahead of the pug mill inlet 108. The latter arrangement is illustrated in FIG. 3 which shows a spray bar 150 for directing rejuvenating fluid at or ahead of the pug mill inlet 108.

The above description is intended in an illustrative rather than a restrictive sense. Variations to the specific embodiments described may be apparent to those skilled in such apparatus and processes without departing from the spirit and scope of the invention as defined by the claims set out below.

I claim:

1. An asphalt pavement resurfacing machine having a transport structure, a heater mounted to said transport structure for heating an underlying surface to form a heated surface, a scarifier mounted to said transport structure to follow said heater and break up said heated surface to form a scarified surface, a mill mounted to said transport structure to follow said scarifier, grind said scarified surface to form a milled material and to prepare said underlying surface to a preset depth, a rejuvenating fluid sprayer for introducing a rejuvenating fluid to said milled material and a mixer for blending said milled material with said rejuvenating fluid, said mixer having a first stage comprising:

a first stage shell having a downwardly facing bottom opening;

said first stage shell further having an inlet opening facing in a travel direction of said transport structure for admitting said milled material into said first stage;

a first stage shaft extending transversely relative to said travel direction and mounted to said first stage shell for rotation about a first stage shaft axis within said first stage shell;

a plurality of paddles extending radially from said first stage shaft for blending said rejuvenating fluid with said milled material within said first stage shell and for directing said blended material thus formed toward a first stage discharge outlet facing rearwardly relative to said travel direction; and, a rotator for rotating said shaft along with said paddles wherein, said first stage shell is placeable in close proximity to said underlying surface with said bottom opening adjacent thereto, said first stage being operatively combinable with the underlying surface to form a substantially enclosed chamber with said first stage shaft and said paddles being rotatable within the substantially enclosed chamber to blend the milled material with the rejuvenating fluid.

2. An asphalt pavement resurfacing machine according to claim 1 wherein said mixer further has a second stage mounted to follow said first stage and receive said blended material from said discharge outlet of said first stage, said second stage comprising:

a downwardly opening second stage shell extending from a rear of said first stage shell;

a second stage shaft mounted in said second stage shell for rotation about a second stage shaft axis generally parallel to said first stage shaft axis;

a plurality of paddles extending substantially radially from said second stage shaft and rotatable therewith for further blending said blended material and directing said blended material toward a second stage discharge opening through said second stage shell facing rearwardly relative to said travel direction; and, a rotator for rotating said second stage shaft about said second stage shaft axis.

3. An asphalt pavement resurfacing machine as claimed in claim 1 wherein:

said rotator includes a motor rotationally coupled to said first stage shaft.

4. An asphalt pavement resurfacing machine as claimed in claim 3 wherein:

said motor is rotationally coupled to said first stage shaft by a motor sprocket mounted to said motor to drive a corresponding first stage shaft sprocket mounted to said first stage shaft by a chain extending thereabout.

5. An asphalt pavement resurfacing machine as claimed in claim 2 wherein:

said rotator for said first and second stages includes a motor rotationally coupled to said first and second stage shafts.

6. An asphalt pavement resurfacing machine as claimed in claim 5 wherein:

said motor is rotationally coupled to said first and second stage shafts by a motor sprocket mounted to said motor and coupled by chain to corresponding first and second stage shaft sprockets mounted respectively to said first and second stage shafts.

7. A method for blending milled material with rejuvenating fluid in an asphalt pavement resurfacing machine having a first pug mill attached thereto in an inverted arrangement in which said pug mill has a housing with an open bottom face, said first pug mill having a first paddle shaft mounted within said housing and extending generally transversely relative to a travel direction of said transport structure, said method comprising the steps of:

(i) placing said open bottom face of said housing of said pug mill adjacent an underlying surface to define, in conjunction with said housing, a substantially enclosed chamber containing said first paddle shaft therein;

(ii) moving said transport structure along said underlying surface to move said first pug mill in said travel direction;

(iii) receiving said milled material and rejuvenating fluid into said first pug mill through a forwardly facing first inlet;

(iv) blending said milled material with said rejuvenating fluid by rotating said first paddle shaft within the substantially enclosed chamber to cause paddles extending radially therefrom to co-mingle said milled material with said rejuvenating fluid within said substantially enclosed chamber, said paddles being aligned to direct a blended material thus formed toward a rearwardly facing first discharge opening; and, (v) allowing said blended material to be discharged, through said first discharge opening as said first pug mill moves in said travel direction.

8. A method according to claim 7 wherein a second pug mill is attached to said transport structure to follow said first pug mill, said second pug mill having a housing with an open bottom face, said second pug mill having a second inlet for receiving said blended material discharged from said first discharge opening, said second pug mill having a second paddle shaft mounted within said housing generally parallel to said first paddle shaft and having a plurality of paddles extending substantially radially therefrom, said method including the further steps of:

(vi) placing said open bottom face of said housing of said second pug mill adjacent said underlying surface;

(vii) receiving said blended material into said second pug mill through said second inlet;

(viii) rotating said second paddle shaft to further blend said blended material received from said first pug mill, said paddles being aligned to direct further blended material thus formed toward a rearwardly facing second discharge opening; and, (ix) discharging said further blended material in a windrow from said second discharge opening.

9. A method according to claim 8 wherein:

said first and second paddle shafts are rotated simultaneously by a motor rotationally coupled thereto by a chain and sprocket drive arrangement.

10. A method according to claim 9 wherein:

said chain and sprocket drive arrangement includes at least one sprocket affixed to an output shaft of said motor, at least one first sprocket affixed to said first paddle shaft; and at least one second sprocket affixed to said second paddle shaft and at least one drive chain extending between said motor and first and second sprockets for transmitting rotational force from said output shaft to said first and second paddle shafts.

11. A method as claimed in claim 7 wherein:

said rejuvenating fluid is added to said milled material ahead of said pug mill.

12. A method as claimed in claim 7 wherein:

said rejuvenating fluid is added to said milled material after milling and ahead of said first pug mill.

* * * * *

UNITED STATES PATENT AND TRADEMARK OFFICE

CERTIFICATE OF CORRECTION

PATENT NO. : 6,416,249 B1
DATED : July 9, 2002
INVENTOR(S) : Francesco A. Crupi

It is certified that error appears in the above-identified patent and that said Letters Patent is hereby corrected as shown below:

Column 4,
Line 54, delete space between "1" and "16" so it reads -- generally in the direction of arrows 116 toward a discharge --
Line 55, delete space between "1" and "18" so it reads -- outlet 118. The discharge outlet 118 faces rearwardly --

Signed and Sealed this

Eleventh Day of February, 2003

JAMES E. ROGAN
*Director of the United States Patent and Trademark Office*

US006416249C1

(12) EX PARTE REEXAMINATION CERTIFICATE (5339th)

United States Patent

Crupi

(10) Number: US 6,416,249 C1

(45) Certificate Issued: Apr. 11, 2006

(54) MIXING APPARATUS AND METHOD FOR BLENDING MILLED ASPHALT WITH REJUVENATING FLUID

(75) Inventor: Francesco A. Crupi, 2845 Seabreeze Dr. South, Gulfport, FL (US) 33707

(73) Assignee: Francesco A. Crupi, Gulfport, FL (US)

Reexamination Request:
No. 90/006,484, Dec. 18, 2002

Reexamination Certificate for:

| | |
|---|---|
| Patent No.: | **6,416,249** |
| Issued: | **Jul. 9, 2002** |
| Appl. No.: | **09/592,398** |
| Filed: | **Jun. 13, 2000** |

Certificate of Correction issued Feb. 11, 2003.

(51) Int. Cl.
*E01C 23/12* (2006.01)

(52) U.S. Cl. ..... 404/91; 404/92; 404/95; 404/77; 404/90; 404/75

(58) Field of Classification Search ..... 404/75, 404/77, 90, 91, 92, 95, 82
See application file for complete search history.

(56) References Cited

U.S. PATENT DOCUMENTS 3,732,023 A * 5/1973 Rank et al. ..... 404/90
4,979,847 A * 12/1990 Simonson ..... 404/92

OTHER PUBLICATIONS

Hot–in–Place brochure publicly distributed in 1997 ("1997 HIP Brochure," Exhibit 1.
Specifications by the Mich.Depmt of Transportation, Michigan Project STP 9674(004) dated Jun. 7, 1996 ("1996MDOT Specs," Exhibit 3).

* cited by examiner

*Primary Examiner*—Gary Hartmann

(57) ABSTRACT

A blending apparatus which forms part of an asphalt pavement resurfacing machine has first and second stages. The first stage receives milled material through an inlet and blends the milled material with a rejuvenating fluid. The first stage has a transversely extending shaft from which paddles extend radially to blend the milled material with the rejuvenating fluid and direct it toward a first stage outlet. The second stage receives the blended material from the first stage outlet. The second stage has a respective shaft with mixing paddles extending radially therefrom to further blend the material and direct it toward a second stage outlet.

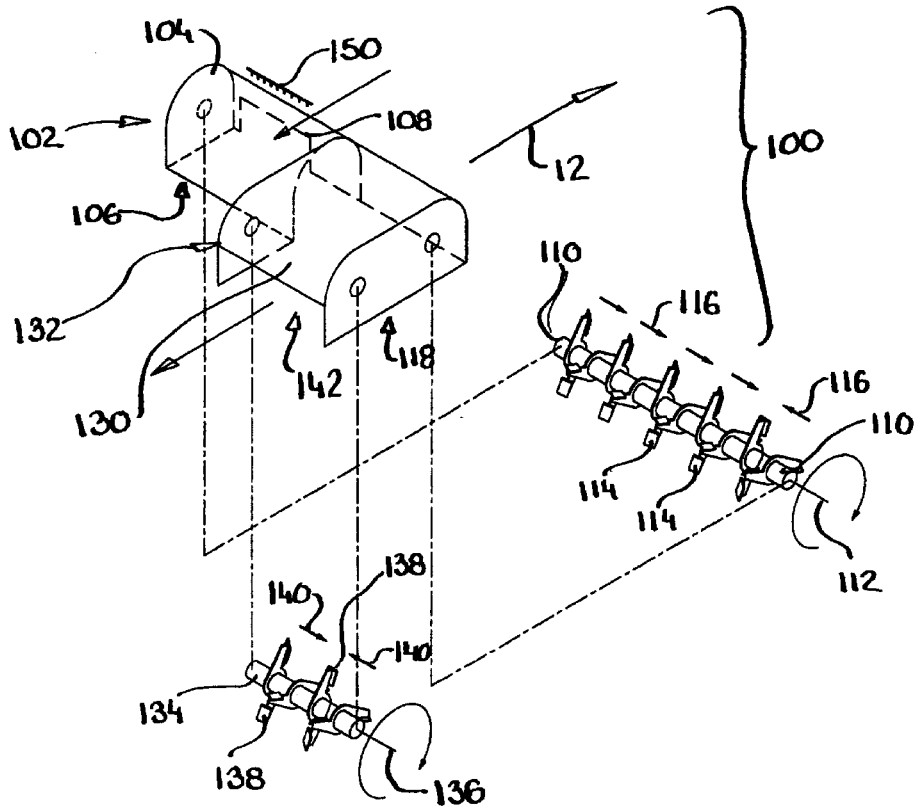

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1–12 are cancelled.

* * * * *